United States Patent [19]

Libit

[11] Patent Number: 4,600,130

[45] Date of Patent: Jul. 15, 1986

[54] SQUEEZE PRESSURE DISPENSER WITH INTEGRAL SIPHON TUBE

[76] Inventor: Sidney M. Libit, 441 Lakeside Ter., Glencoe, Ill. 60022

[21] Appl. No.: 536,727

[22] Filed: Sep. 29, 1983

[51] Int. Cl.[4] ..... B65D 37/00

[52] U.S. Cl. ..... 222/209; 222/211; 222/212; 222/215; 222/464; 222/484; 222/556

[58] Field of Search ..... 222/206, 207, 209–213, 222/215, 394, 401, 464, 478, 481, 482, 484, 488, 489, 502, 545, 547, 556, 563, 567, 568, 562, 479

[56] References Cited

U.S. PATENT DOCUMENTS

| | | | |
|---|---|---|---|
| 64,436 | 5/1867 | McIntire | 222/478 |
| 308,106 | 11/1884 | Stimpson | 222/479 X |
| 2,002,635 | 5/1935 | Kinney | 222/211 X |
| 2,599,446 | 6/1952 | Greene | 222/211 X |
| 2,755,972 | 7/1956 | Nave et al. | 222/211 |
| 3,018,926 | 1/1962 | Gilstrap | 222/211 X |
| 3,141,574 | 7/1964 | Donoghue . | |
| 3,341,083 | 9/1967 | Stewart | 222/209 |
| 3,396,875 | 8/1968 | Finch . | |
| 3,434,635 | 3/1969 | Mason, Jr. | 222/564 X |
| 3,710,989 | 1/1973 | Armour | 222/562 |
| 3,828,962 | 8/1974 | Atkins | 222/562 |
| 4,077,547 | 3/1978 | Donoghue . | |
| 4,105,142 | 8/1978 | Morris, Jr. . | |
| 4,106,673 | 8/1978 | Donoghue . | |
| 4,124,151 | 11/1978 | Hazard | 222/517 X |
| 4,298,038 | 11/1981 | Jennings . | |
| 4,418,843 | 12/1983 | Jackman | 222/207 X |

FOREIGN PATENT DOCUMENTS

| | | |
|---|---|---|
| 0015560 | 9/1980 | European Pat. Off. . |
| 865810 | 2/1953 | Fed. Rep. of Germany . |
| 2173838 | 10/1973 | France . |
| 2038779 | 7/1980 | United Kingdom . |

*Primary Examiner*—Joseph J. Rolla
*Assistant Examiner*—Kevin P. Shaver
*Attorney, Agent, or Firm*—Hill, Van Santen, Steadman & Simpson

[57] ABSTRACT

A dispenser container and container cap combination with the container formed of a molded plastics body having an integral section forming a tube extending from the fluid bottom area of the container to the container neck opening. The cap having a stopper portion closing a filling part of the container neck opening and having a dispensing orifice in communication with the tube portion of the container.

20 Claims, 14 Drawing Figures

SQUEEZE PRESSURE DISPENSER WITH INTEGRAL SIPHON TUBE

BACKGROUND OF THE INVENTION

1. Field of the Invention

This invention relates to containers and more particularly to dispensing containers of the squeeze type.

2. Prior Art

Dispensing containers are extremely common and include molded plastic containers which, due to the resiliency and elastic memory of the plastic, function as squeeze type containers. These containers are generally used in association with dispensing caps such as, for example, caps having dispensing spouts, openings, orifices, etc. In order to use such containers, it is generally necessary that the container be inverted so that the fluid is flowed to the spout area of the cap for expulsion therefrom when the volumetric capacity of the container is decreased by squeezing.

In order to avoid the necessity of upending the container, it has been known to utilize tubes extending from the dispensing portion of the cap downwardly through the fluid to the bottom of the container. When such containers are squeezed, the elevation of the internal pressure by reason of the volumetric reduction will force the fluid through the tube, then through the dispenser of the cap. While such tube type dispensing containers may be generally effective for some fluids, they are expensive to assemble in that they require the assembly of the tube onto the cap and the hand assembly of the cap onto the container, the presence of the tube being such as to generally interfere with the use of standard cap attaching machinery.

Further, standard prior art dispensing type containers which are squeezable generally must be formed of relatively thin materials and the materials selected must fall within a relatively narrow range in view of the necessity of the container's resiliency being strong enough to cause the container to return to the unsqueezed shape after having been sqeezed. Where such containers are used in connection with tube dispensers, i.e., that type of cap which relies upon a depending dispensing tube, and where the material to be dispensed is relatively thick, the dispensing container may not have adequate strength to return to its unsqueezed condition. This is particularly true where it is necessary for the atmosphere then to be drawn back into the interior of the container through the dispensing opening and the dispensing tube.

It would be a significant advance in the art to provide an improved dispensing container and cap combination which eliminates one or more of the above disadvantages.

SUMMARY OF THE INVENTION

This invention consists of a two part assemblage which together define a dispensing container assembly. The container itself is a molded plastic part having an integrally formed dispensing tube. The container has an opening closed by a cap, the cap being configured to provide a dispensing orifice in communication with the dispensing tube and a stopper portion stopping a filling neck opening or throat opening to the container. The container may be a standard squeeze container or may be specially provided with collapsible portions which function as pumping sections for elevating the internal pressure of the container.

The cap may be a single piece cap or a multi-piece cap, may be provided with stoppers for the dispensing orifice, may further be provided with air flow openings for allowing controlled air flow to the interior of the container to allow it to return to its unsqueezed shape, and may be provided with valves controlling the air flow.

In the preferred embodiment, the container is formed as a standard molded plastic material container modified to provide a dispensing tube formed as a pinched-off portion of the container. The techniques for forming such containers with pinched-off portions are well known and are used, for example, in present day manufacture of plastic milk bottles and the like having hollow handle portions which are formed by pinch-off techniques. By pinch-off techniques, as that phrase is used in this case, I refer to molding techniques where a parison is blown to fill a cavity in an opposed mold set and where, during the closure of the mold set, or of portions of the mold set, a portion of the blown parison is separated from the remaining portions of the container either completely or by the formation of squeezed-together wall portions. It will be appreciated that I do not intend to restrict the practice of this invention unless otherwise specified to any single manufacturing method.

The preferred embodiment container has a neck portion which defines both a filling area and a dispensing area, the neck portion terminating in a section for affixation of the cap. Inasmuch as many variations are possible in the actual shape of the container and the construction of the neck portion, there is no single preferred embodiment. In order to describe my invention in consistent terms, I will herein refer to containers as having main body portions, by which I mean to refer to the primary or sole contents containing portion, and as having neck portions, by which I mean to refer to that portion of the container which defines the main opening to the main body and through which the contents are generally filled and dispensed. It will be understood that these terms are not limiting and that a large variance in container shapes and styles is anticipated. The container neck will generally have means for affixing a cap. The cap may be a one-piece or a multi-piece device but will generally be equipped with a stopper which closes the filling opening of the neck and with a dispensing opening which is open to the area of the neck which in turn is opened to the dispensing tube.

Additionally, in order to facilitate ease of dispensing of material while at the same time allowing the container itself to be manufactured of a wide range of plastics and in varying degrees of material thickness, the container may be formed with separate areas which are inherently more susceptible of collapsing and returning to original shape then are other areas of the container. These localized collapsible areas can then form the primary volumetric reduction areas for increasing the pressure internally of the container. By localizing and specifically designing these areas, it is possible to form the remaining portions of the container out of material which would not otherwise have sufficient elasticity to return to its unsqueezed shape either because of the nature of the material used or because of the thickness of the material used.

In a first illustrated embodiment, the container is provided with a neck portion extending from a side thereof. In this embodiment, the dispensing tube extends from the bottom of the main body up the side and joins with the neck portion on the underside of neck portion. In another illustrated embodiment, the neck portion extends from the top of the container adjacent a side and the dispensing tube extends upwardly along the opposite side of the container and is segregated from the container main body for a major portion of its length by a cut-out whereby the tube forms a handle portion as opposed to being connected by a web as is the case in other embodiments. In yet another illustrated embodiment, the container may be formed with a more normal hollow handle formed as a pinch-off portion and with a second pinched-off portion providing a tube portion, the tube portion being formed separately from the handle portion. It should be appreciated that the use of an integral tube allows for precise positioning of the tube to maximize contents dispensing by proper location of the tube bottom.

In various embodiments, the cap may include simple open dispenser necks, compound stoppers, etc., depending upon the desired usage of the container. Finally, in another preferred embodiment, the cap can be formed as a portion of an over-cap covering an entire end section of the container and the associated dispensing tube. Variations of all of the illustrated embodiments will be readily apparent to those skilled in the art.

It is therefore a primary object of this invention to provide a dispensing container and cap combination wherein the container is formed of a molded plastic and has an integrally formed dispensing tube extending from a fluid bottom area to a dispensing orifice defined by a cap which is applied to close a filling opening to the container.

It is another, and more particular object of this invention, to provide a dispensing container and cap combination wherein the container is formed with an integral dispensing tube extending from a neck area downwardly to a fluid bottom area, the neck area projecting from the container, a cap closing the neck, the neck having internal passageways in communication with both the dispensing tube and the upper portions of the container interior, and the cap having means dividing the neck into two separate areas with a first area open to a dispensing orifice of the cap and with the dispensing tube and the second area closing the filling orifice of the neck.

It is yet another, and more specific, object of this invention to provide a dispensing container and cap combination wherein the container is formed of molded plastic, has a dispensing tube molded integrally therewith, the container having a filling opening, the dispensing tube and filling opening being in close spaced relationship at a cap affixing portion of the container, and the cap being divided into two areas, a first area being in communication with the dispensing tube and with a dispensing orifice from the cap and the second area forming a stopper for the filling orifice of the container.

Yet another and more specific object of the invention is to provide a dispensing container and cap combination, the container formed of a molded plastic having portions thereof defining collapsible areas for increasing the internal pressure of the container, the container including an integrally molded dispensing tube extending from a bottom area of the container to a neck portion of the container, the neck portion including a filling opening for the container, a cap for closing said neck portion, the cap having both dispensing and stopper areas, the stopper area effective to prevent communication between the dispensing tube and the container at the neck portion, the dispensing area open to a dispensing orifice from the cap.

Other objects, features and advantages of the invention will be readily apparent from the following description of a preferred embodiment thereof, taken in conjunction with the accompanying drawings, although variations and modifications may be effected without departing from the spirit and scope of the novel concepts of the disclosure, and in which:

DESCRIPTION OF THE PREFERRED EMBODIMENTS

Figure 1:
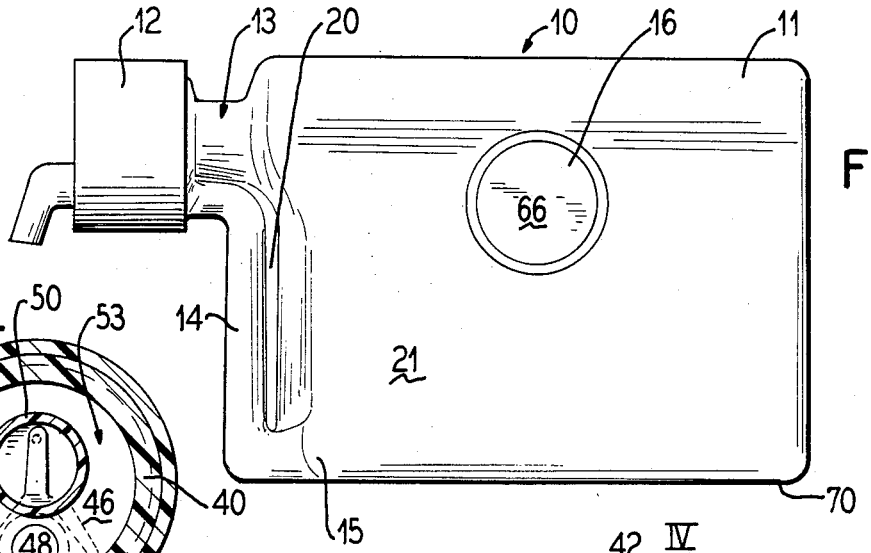
FIG. 1 is a side elevational view of a dispensing container and cap assembly according to this invention.
Figure 4:
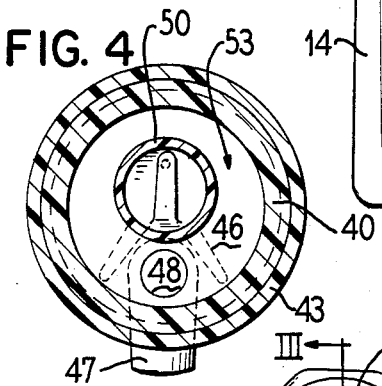
FIG. 4 is a cross-sectional view of the cap and neck portion of the container taken along the lines IV—IV of FIG. 3.

As illustrated in FIG. 1, the dispensing container and cap combination 10 of this invention consists of a container 11, and a cap assembly 12. The container is preferably formed as a molded plastic member and may take any desired form. The container will generally include a neck portion 13 located at a top of the container and will include a dispensing tube 14 extending from a bottom area 15 of the container to the neck 13. The cap 12 will be affixed to the container at the neck. The container may include a collapsible portion or portions 16 which are integrally molded with the remainder of the container 11 and which are designed to collapse and to return to their expanded uncollapsed state allowing them to act as individual pumps for increasing the interior pressure of the container to force a fluid from the container out of the container dispensing tube 14.

The container may preferably be formed in a pinch molding operation which allows the dispensing tube 14 to be formed from the container material and to be separated from the remainder of the container by a land 20 which may be a web of material between the main body 21 of the container and the dispensing tube 14. It is also known to form openings where the web 20 of the container of FIG. 1 is located, the openings either being formed during the molding of the bottle or being separately formed later by cutting out the web 20. In any such operation, the container may be formed in any desired shape, it being understood that the particular method used to form the container forms no part of my invention, the only important feature being the provision of a dispensing tube molded integrally with the container so as to eliminate entirely the necessity of a separate dispensing or siphon tube being carried by the cap.

Figure 3:
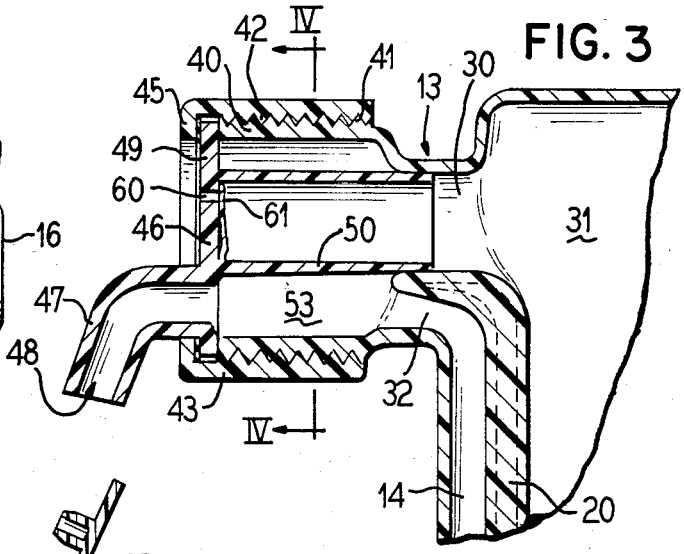
FIG. 3 is an enlarged fragmentary cross-sectional view taken along the lines III—III of FIG. 2.
Figure 2:
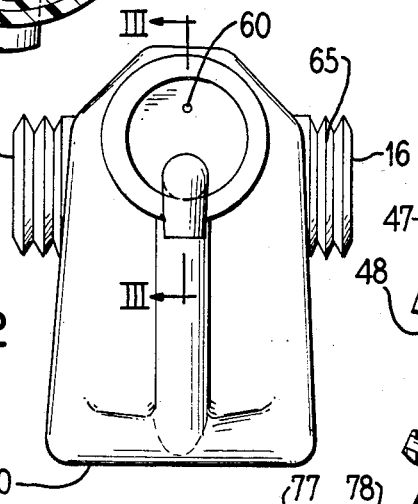
FIG. 2 is an end elevational view of the container of FIG. 1 taken from the left hand end of FIG. 1.

In the embodiment illustrated in FIG. 1, the neck 13 extends from a side of the container 21 and, as best illustrated, in the cross-section of FIG. 3 includes a main neck portion 30 functioning as a filling opening to the interior 31 of the main portion 21 of the container and a dispensing tube portion 32 which communicates to the interior of the tube 14. In this embodiment, the neck 13 extends outwardly into a enlarged cap receiving portion 40 having external male threads 41 for receipt of the internal threads 42 of the cap skirt 43.

It will be appreciated that the filling opening 30 of the neck portion 13 is not concentric with the enlarged portion 40 in the embodiment illustrated. For this reason, the cap 12 is formed as a two piece assembly, including an outer portion 45 which defines the skirt 43 and which has an axially inturned lip at one end. Carried by the cap below the lip internally of the skirt portion is a stopper and dispenser portion 46 which includes a dispensing orifice 48 formed at the end of a goose neck-like projection 47 from the end wall 49 of the portion 46. Internally of the cap assembly, a stopper member 50 depends from the end wall 46. The stopper member 50 is cylindrical and is eccentric with respect to the center of the end wall 46 so as to provide alignment with the filling opening 30 of the neck. The stopper portion 15 thus precludes communication between the interior 31 of the main body portion 21 of the container 11 and the exterior atmosphere except through the tube 14. The tube 14 opens to the area 53 radially outwardly of the stopper 15 and radially inwardly of the wall portion 41 of the portion 40 of the neck. The dispensing orifice 48 also opens to the area 53.

As illustrated in FIG. 3, the end wall portion 46 may be provided with an aspiration opening 60 therethrough closed by a read valve 61 formed interiorly of the stopper 50. This will allow air to be sucked into the interior of the container through the filling opening 30 at the upper portions of the container to allow the container to return to its uncollapsed or unsqueezed shape.

To facilitate dispensing, the collapsing portions 16 may be formed at the time the bottle is molded. The portions may, for example, be bellows-type projections from the container sides and may include a bellow-circumferential wall 65 which is closed by an end face 66 and with the end face 66 normally positioned outwardly from the side walls of the container and the bellows wall 65 being both collapsible and having elastic memory resiliency to return to its expanded shape.

Although it is not absolutely necessary to have the aspiration opening 60, by providing the aspiration opening, it is not necessary for air to be sucked in through the dispensing opening 48 and then through the tube 14. In this manner, the tube 14 may remain substantially full of liquid, at least to the level of the liquid interior of the main container, thereby reducing the amount of squeezing necessary for dispensing at a succeeding time. Where the fluid is thick, it would be impractical to attempt to aspirate the container through the tube 14 in those instances where the container is relatively large and the tube therefore relatively long.

It will be appreciated that in the embodiments shown in FIG. 1, dispensing of items such as hand lotions is facilitated by having the dispensing opening 48 elevated above the base 70 of the container and projecting from a side of the container rather from the top. In this manner, it is not necessary to lift the container, the hand may be placed under the dispensing opening and the container squeezed or, if equipped with the dispensing assisting collapsing portion 16, those portions may be squeezed to dispense contents to the hand of the user via the orifice 48.

Figure 5:
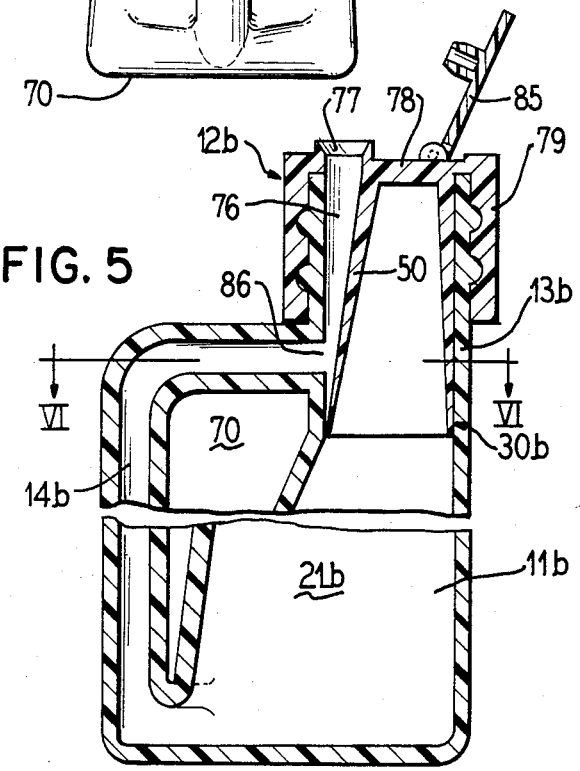
FIG. 5 is a vertical cross-sectional view of another embodiment of a dispensing container and cap combination.
Figure 6:
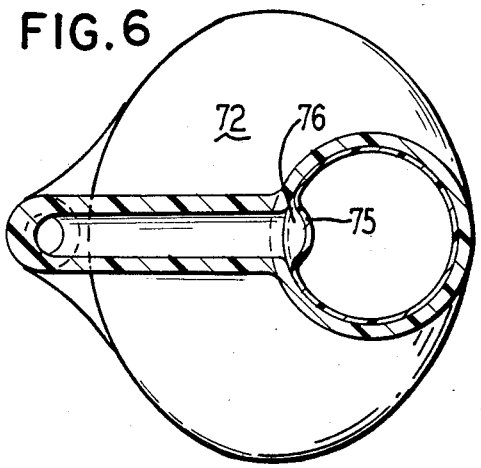
FIG. 6 is a horizontal cross-section of the dispensing cap container of FIG. 5 taken along the lines VI—VI of FIG. 5.

FIGS. 5 and 6 illustrate a variation of the combination container and cap of FIG. 1. In this variation, the container **11*b* is formed with an offset top neck 13*b* which may be aligned adjacent the periphery to one side of the container and which projects upwardly as is normal in container necks. The dispensing tube 14*b* extends from the bottom of container upwardly along the opposite periphery and in spaced relationship to the main portion 21*b*. The spacing is provided by a hollow opening 70 which allows the dispensing tube 14*b* to form a grasping handle for the container. In this example, the tube then extends across the top 72** of the container in spaced relation to the top and opens into the neck portion from a side thereof.

The cap **12*b* is, however, constructed substantially differently from the cap 12. The cap 12*b* is substantially one piece, eliminating the end wall 46 as a separate piece. The stopper section 50 is substantially concentric with the skirt having a inwardly directed bulged portion 75 over a portion of its circumference, the bulge portion 75 defining a sloped channel 76 which terminates in a dispensing orifice 77 of the cap top 78. In order to allow the stopper to be substantially concentric with the skirt 79, the tube 14*b* has its horizontal portion communicating with the interior of the neck 13*b* above the filling opening 30*b*. Because of the concentricity of the stopper and skirt 70, it is not necessary for the stopper to be formed as a separate portion as is the case in the cap of FIG. 1 where, due to the eccentricity of the stopper, it was not possible to rotate the stopper along with the cap skirt when the cap was being threaded onto the neck of the container. For that reason, the skirt was formed as a portion of a part of the cap assembly that could remain stationary with respect to the container during rotation of the skirt. In the embodiment of FIGS. 5 and 6, however, it is necessary that the stopper portion be precisely located with respect to the tube at the time of full assembly of the cap to the container since it is necessary for the bulged portion 75 defining the channel 76 to be aligned with the horizontal termination 80 of the tube 14*b*. It will be appreciated that because the stopper forming portion 46 of the cap assembly of FIG. 1 does not rotate with the skirt, it was not necessary to be concerned with the relative position of the skirt at the time it is fully tightened on the container neck as it is with respect to the embodiment of FIG. 5 where alignment of the skirt, integrally formed with the remainder of the cap including the opening 77**, is a consideration.

Also illustrated in FIG. 5 is the use of a pivoted stopper member 85 for closing the dispensing orifice opening 77, the stopper member 85 being carried by the cap and being affixed thereto in a manner known to the art.

Figure 7:
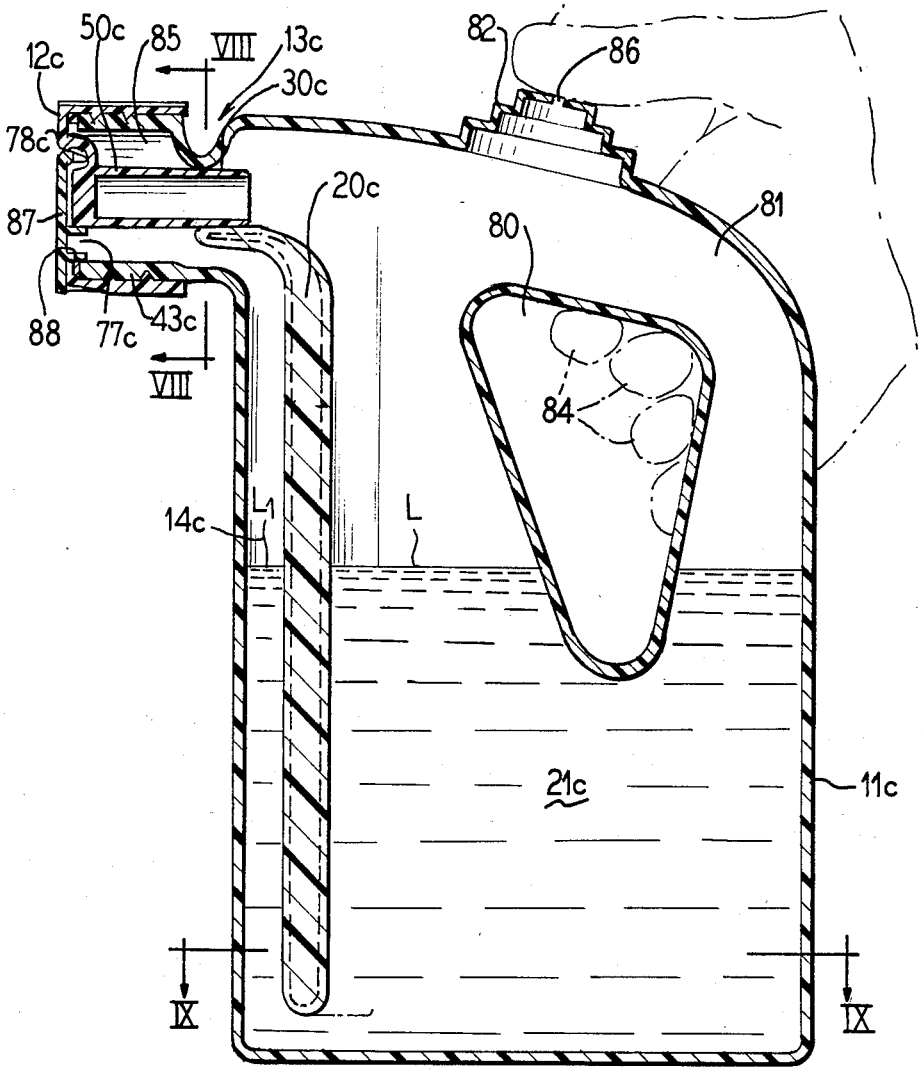
FIG. 7 is yet another embodiment of the dispensing container and cap combination of this invention taken in vertical cross-section.
Figure 8:
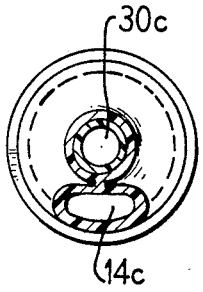
FIG. 8 is a sectional view of the neck and portions of the cap of FIG. 7 taken along the lines VIII—VIII of FIG. 7.
Figure 9:
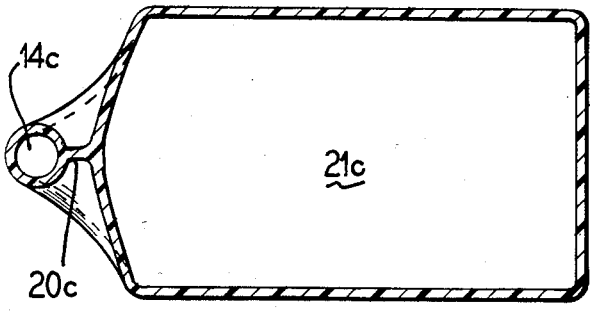
FIG. 9 is a horizontal section of the container of FIG. 7 taken along the lines IX—IX.

FIG. 7 illustrates yet another embodiment of this invention. In FIG. 7 the container 11*c* has a first pinched-off portion defining the tube 14*c*, the pinched-off portion being connected to the main body portion 21*c* by means of a web 20*c*. A second separated portion defines a cut-out 80 defining a handle section 81. The handle section may be aligned with a collapsible section 82 such that a hand grasping the container 11*c* at the handle section 81 would have a thumb overlying the collapsible portion 82. In this manner, this container is capable of acting as a thumb pump bottle where the dispensing pressure is applied easily by the thumb 83 in opposition to the fingers 84 which are received in the opening 80.

The container 11*c* has a horizontally extending neck portion 13*c* which has a skirt portion 43*c* which is concentric with the filling opening or main neck portion 30*c*. This allows the stopper portion 50*c* of the cap 12*c* to be formed concentric with the skirt integral therewith. Once again by forming the skirt integral with the stopper portion, it will necessary to align the dispensing opening 77*c* in the cap top 78*c* with the desired position or orientation with respect to the container by controlling the position of the skirt portion at the time of full assembly. However, it is not necessary to concern oneself about the position of the opening 70*c* with regard to the ability of the device to dispense product since the entire circumferential area surrounding the skirt is in communication with the tube 14*c*, unlike the bulged portion skirt assemblage of FIGS. 5 and 6. That is, the area 85 radially outwardly of the stopper 50*c* is opened to the tube 14*c* and is blocked off from the main body portion 21*c* by means of the stopper 50*c*. For this reason, upon elevation of internal pressure within the main body by activation of the collapsible portion 82, the liquid level L would be caused to decrease in the main body portion and the liquid level L1 in the tube to be elevated until the entire area 85 is filled at least to the level of the dispensing opening 77*c*. Therefore, if the dispensing opening 77*c* is at the top, as opposed to the bottom position illustrated, the contents will still be dispensed.

In the embodiment illustrated in FIG. 7, replenishment of the displaced volume interiorly is accomplished through an air vent 86 located in the collapsible portion 82 under the thumb 83 of the user. Of course, it is to be understood that the air vent could be located in the cap as in prior embodiments. However, since, in the embodiment illustrated, the cap includes a pivoted stopper member 87 which contains an undersurface stopper 88 for closing the orifice 77*c* and because the pivoted stopper member overlies the main stopper 70*c*, it would not be possible for the atmosphere orifice 86 to be located centrally of the cap in communication with the stopper as is the case, for example, with FIG. 3, since the member 87 would overlie such an opening.

Figure 10:
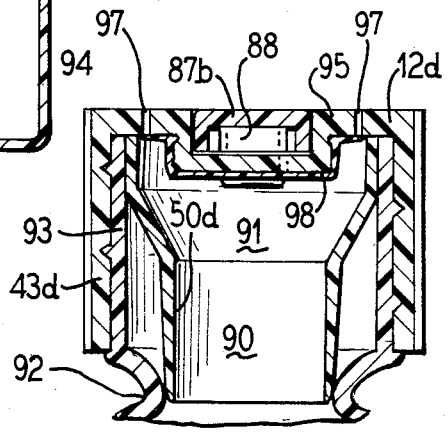
FIG. 10 is a cross-section of a neck and cap portion of a dispensing container according to this invention.
Figure 11:
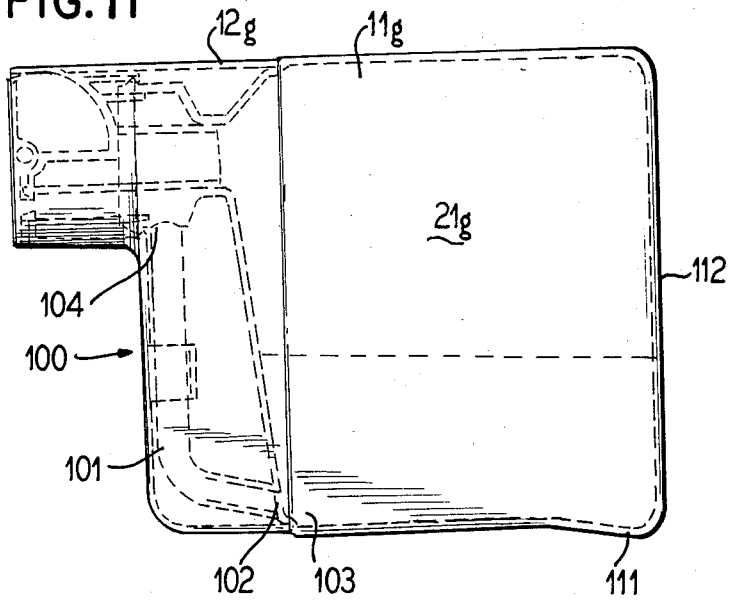
FIG. 11 is another embodiment of a dispensing container and cap shown in a view similar to FIG. 1.
Figure 12:
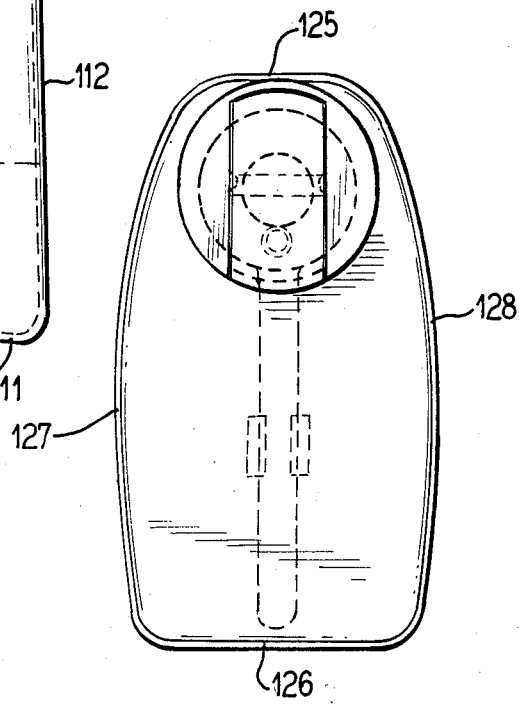
FIG. 12 is an end view of the container of FIG. 11.
Figure 13:
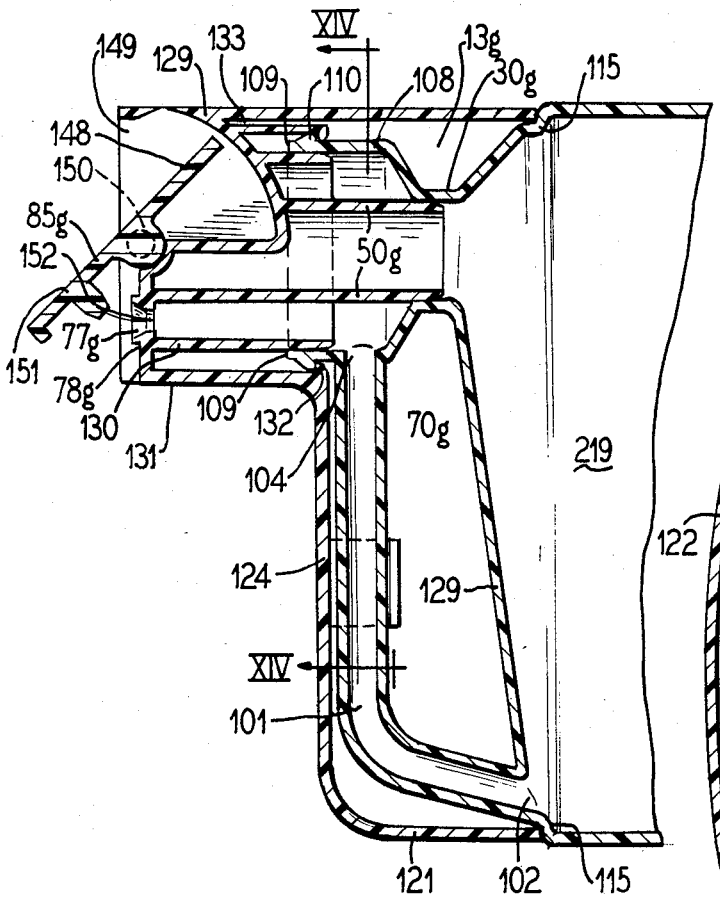
FIG. 13 is an enlarged fragmentary sectional view of the container of FIG. 11.
Figure 14:
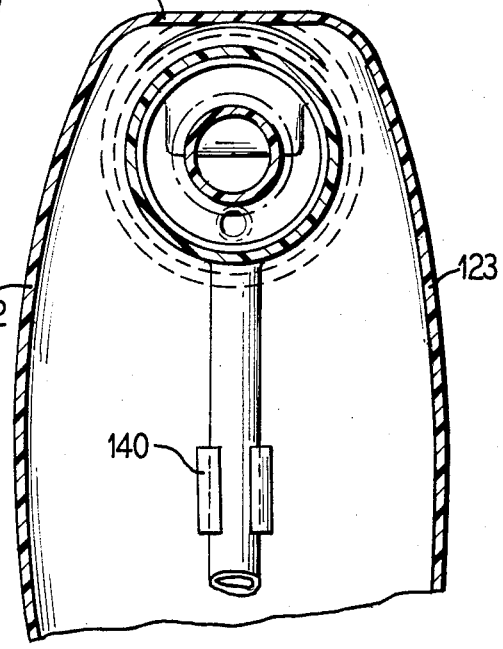
FIG. 14 is a sectional view of the container of FIGS. 11 through 13 taken along the lines XIV—XIV of FIG. 13.

This problem can be overcome with, for example, cap of the type shown in FIG. 10. The cap has a stopper member 50*d* which has a circular bottom portion 90 and an eliptical upper portion 91. The circular bottom portion acts to close the constricted neck 92 of the container (not shown), the neck 92 being the filling opening. The eliptical upper portion 91 will extend outwardly into engagement with the inner diameter wall of the threaded portion of the container neck 93 and may terminate in an outwardly flanged portion 94. Because the top portion is oval, and because the cap 12*d* is formed with a circular skirt 43*d* and a circular top, the oval portion 91 will approach and contact the wall 93 only at diametrically opposed portions. For this reason, the undersurface of the cap top 95 may be provided with cut-out areas for receipt of the out-turned flange portions 94. The out-turned flange portions 94 can therefore form attachment points for permanently affixing the stopper portion to the undersurface of the cap 12*d*.

Atmospheric resupply openings 97 can then be formed through the top of the cap offset from the center thereof and communicating with the interior of the stopper 50*d* at points radially outwardly of the outermost diameter of the circular portion 90 which closes the neck constriction 92. This allows the openings 97 to be positioned out of the center plane which is taken up by the pivoted stopper member 87*b* which carries the stopper 88 for the dispensing orifice.

A flapper valve member 98 may be affixed to the undersurface of the top 95 closing the orifices 97, the flapper valve being of the type that will open to allow a resupply of air to the interior. Because of the use of a single piece flapper as shown, it is necessary that the stopper 50*d* be formed as a separate piece from the cap so that the flapper valve assembly can be assembled in position to the undersurface of the cap prior to the assembly of the stopper to the cap. However, it is desired that the stopper be firmly affixed to the cap so as to be not separable therefrom when the cap is off of the container.

It will be appreciated that up until now thread-on caps have been shown. Such caps do create the necessity of aligning the dispensing opening either with the dispensing tube, as is the case in the embodiment of FIG. 5, or with the particular position or orientation that is desired for the dispensing opening to have, as is the case with the embodiments of FIG. 1 and FIG. 7. However, it is possible to form a cap as a snap-on rather than a thread-on, which eliminates many of the alignment problems. The embodiment of FIGS. 11 through 14 illustrates, among other features, a snap-on cap. In this embodiment, the cap is designed as an end cover for the container and not only closes the container neck, but encloses the entire end of the container, in the embodiment illustrated, the left end of FIG. 11, the container being formed with a side opening neck.

In the embodiment illustrated, the container 11*g* may be of the type designed for dispensing hand lotions or soaps or similar articles. For this reason, the dispensing end is elevated and located to one side of the container. That side, 100, is provided with a dispensing tube 101 which has a first end 102 in communication with the bottom portions 103 of the main body section 21*g*. The upper end 104 of the tube communicates with the underside of the neck portion 13*g* exteriorly of the constricted filling opening 30*g*. The end 104 is open to the enlarged portion 108 of the neck radially thereof. The enlarged portion terminates in an annular end face 109 defining the mouth of the neck. An outer diameter enlargement 110 spaced axially of the end 109 forms a latch hook for the cap 12*g*. The container may have a downwardly bulged bottom portion 111 spaced adjacent the side or end 112 opposite the side or end 100 in order to flow liquid to the end 102 of the dispensing tube. The dispensing tube, in this instance, is formed of a completely separated tube, similar to the separation of FIG. 5 such that the tube is spaced from the main body 21*g* by an opening 70*g*.

The container body is dimensionally reduced to provide a reduction ledge 115 adjacent the side 100. The reduction is made to allow the cap 12*g* to conform substantially to the outer diameter of the main body portion as an extension of the main body portion. As can be seen, the cap forms a substantially co-dimensional extension of the main body portion having sidewalls 122 and 123, top wall 120 and bottom wall 121 which are substantially planar extensions of sidewalls 127 and 128, top wall 125 and bottom wall 126 of the main body portion of the container. The cap has a top or end wall 124 which extends the end wall 129 of the container and which overlies the dispensing tube 101. The wall 124 terminates in a cylindrically raised boss portion 129 which overlies the neck of the container. The cylindrical portion 129 has three concentric wall portions, the inner concentric wall portion forming the stopper 50*g* which closes the reduced dimension neck portion 30*g*, the intermediate wall portion 130 engaging the inner diameter of the enlarged portion 108 of the neck 13*g* adjacent the ends 109 and adjacent the latch 110, and an outer wall portion 131 which defines the outside and which, on its inner face, has a counterlatch 132 to the latch 110. As can be seen from the top of FIG. 13, the outer wall 131 may be a split wall as at 133 for a portion of its circumference in order to provide resiliency to the counterlatch.

It will be appreciated that the latch and counterlatch provide a snap attachment of the cap to the container. A further snap on latch can be provided on the undersurface of the wall portion 134 as at 140 with this portion latching about the dispensing tube 101 to firmly affix the cap to the container. The provision of wall 130 allows the tube end 104 to be open to the area between walls 130 and the wall of the stopper 50*g*.

In addition, a top wall 78*g* may be provided having pivotably affixed thereto a hinged stopper 85*g*. The hinged stopper 85*g* may be formed as a teeter-totter having a free end 148 overlying a recess 149 so as to allow depression of the portion 148 to pivot the member 85*g* about intermediate pivot 150 to raise the stopper portion 151 until the stopper 152 is removed from the dispensing opening 77*g*. In the embodiment illustrated, this can be done with the index finger of a hand grasping the container about the top of the container, the index finger extending along the top portion 120, over the end of the extended boss and depressing the portion 148 of the pivoted member 85*g*. Thereafter, mere heel pressure from the hand on the main body portion 21*g* will cause an elevation of the internal pressure sufficiently large to cause fluid to be dispensed from the dispensing opening 77*g* through the tube 101.

If desired, an atmospheric bleed opening may be provided into the interior of the stopper from, for example, the bottom wall of the recess 149.

It will be appreciated that the various embodiments shown herein provide variations of a common combination of a squeeze dispensing container having an integrally formed dispensing tube extending from adjacent a main body bottom portion to adjacent a neck portion, the dispensing tube formed integrally with and molded simultaneously with the container, the neck portion having a filling opening formed as a constriction of the neck portion spaced dimensionally from the point of opening of the dispensing tube into the neck portion, a cap member closing the neck portion, the cap member having a stopper portion for stopping the filling opening, and a dispensing portion having a dispensing orifice through the cap and having an area open to the dispensing tube externally of the filler tube stopper. The various embodiments shown illustrate different cap designs, different container designs, different tube designs, etc. It will be appreciated that further design modifications and variations will be readily apparent to those of ordinary skill in the art, including, for example, modifications of the bottom of the bulge portion 75 of the embodiment of FIG. 5 to provide a lip seal allowing atmospheric air to be drawn past the lip seal as the bottle expands from its unsqueezed position. Other variations, such as the inclusion of one-way valves and the dispensing tube or dispensing orifice portion of the cap, cap removal prevention features, security seals, etc., will all be apparent.

Although the teachings of my invention have herein been discussed with reference to specific theories and embodiments, it is to be understood that these are by way of illustration only and that others may wish to utilize my invention in different designs or applications.

I claim as my invention:

1. A dispensing container and cap combination comprising a molded plastic container having a main body portion with an interior, a dispensing tube portion with an interior, and a neck portion, the neck terminating in an open end, the neck portion having a filling opening to the main body portion interior and a separate opening to the tube portion interior, the separate openings being spaced below the open end of the neck portion, the tube portion formed integrally with the main body portion and having a first end open to an interior of the main body portion adjacent a bottom thereof and a second end, spaced from the first end open to the separate opening, the tube portion intermediate the first and second ends being separated from the interior of the main body portion, a cap adapted to be received on said container including means closing the filling opening to the neck portion, the cap having means effective to divide the neck poriton into a dispensing passageway and a stopper for the main portion, said cap having a dispensing opening communicating with the dispensing passageway.

2. A dispensing container and cap combination comrpising a blow molded plastic container having an interior and having a main body portion with an interior, a neck portion with an interior and a tube portion, the main body portion interior communicating with the neck portion interior through a filling opening, the tube formed integrally with the container having a first end open to the interior of the container adjacent a bottom of the container and a second end adjacent the neck portion of the container, blow molded means separating the portion of the tube intermediate the ends from the interior of the main body portion whereby the tube defines a flow channel from adjacent the bottom of the main body portion to adjacent the neck which is separate from the communication of the interior of the main body portion to the neck portion interior through the filling opening, the neck portion terminating in an open end, a cap member closing the open end, means dividing the interior of the neck portion inboard of closure of the open end by the cap into two passageways, one of said passageways forming the filling opening to the interior of the main body and the other of said passageways forming a dispensing passageway, the second end of the tube being open to the dispensing passageway, cap carried means blocking communication between the dispensing passageway and the filling opening, and a dispensing opening through said cap being open to the dispensing passageway and being closable by a cap carried pivotable stopper.

3. A skirted dispensing cap and container combination comprising a molded plastics container having an integral dispensing tube extending from a bottom of the interior of a main body portion of the container to a neck portion of the conatiner, the neck portion having an interior the neck portion of the conatiner including a throat opening for filling the main body and a peripheral wall portion for attachment of a cap skirt, the tube communicating to the interior of the neck portion intermediate a mouth opening of the peripheral wall and the throat opening, the cap having said skirt for receipt of said skirt around the peripheral wall and a top for closing the mouth opening, the cap having means depending from an undersurface of the top for closing the throat opening and having a dispensing opening positioned intermediate the skirt and the depending means, whereby the depending means, when the cap is attached to the container, closes the throat opening and defines an area between the depending means and a peripheral wall into which the dispensing tube can dispense liquid contained within the main body portion of the container upon squeezing the container, said area opening to the dispensing opening through the cap.

4. A container and cap assembly comprising: a container having a main body having an end with a container neck projecting from the end, a cap having an exterior and a hollow interior open at one side, means for snap-on attachment of the cap to the container with the container extending into the hollow interior of the cap from the one side, the cap covering substantially the entirety of the container end and neck, a cap orifice open to the neck and to the cap exterior, a cap carried stopper selectively closing the orifice, said neck located to one side of a center of said container end, the container formed with an integral tube having portions separated from the main body, the cap having means providing a snap-on connection to the tube portions.

5. The assembly of claim 4 wherein the container and neck have an interior, the tube interconnecting the interior of the neck and a bottom area of the container interior, the tube being positioned interiorly of the cap when the cap is attached to the container.

6. The assembly of claim 5 wherein the neck includes a constricted throat opening defining a filling opening to the container interior, the tube being connected to the neck exteriorly of the throat and the cap including means closing the throat.

7. A dispensing container and cap assembly comprising: a molded plastics material container having an open ended neck portion with two separate openings thereto spaced from the open end, said separate openings open to an interior of a main body portion of the container, the main body portion having upper and lower portions, the first of the openings being a filling opening open to the upper portion of the main body interior and a second of the openings being a dispensing opening open to a lower portion of the interior of the main body through a dispensing tube formed integrally with the main body and the tube separated from the interior of the main body between an opening of the tube to the lower portion and the second opening, a cap closing the open end and having means to maintain the second opening out of communication with the first opening and a cap carried dispensing opening communicating with the exterior and with the second opening, said cap including means to close the first of the openings, the cap having a top portion with a depending peripheral skirt, the neck having a projecting portion with a peripheral wall, the skirt engaging the exterior of the peripheral wall and affixing the cap to the container, a stopper portion projecting from an undersurface of the top, the stopper portion closing the first of the openings, said cap carried dispensing opening being through said top portion of the cap, the cap carried dispensing opening being in communication with the tube through a portion of the area radially intermediate the cap carried stopper and the peripheral wall of the neck portion.

8. An assembly according to claim 7 wherein the container includes localized collapsible areas for selectively increasing the internal pressure of the container by forcible collapsing of the localized areas.

9. An assembly according to claim 8 wherein the localized collapsed areas inlcude accordian fold projections extending from the main body portion, the accordian fold projections being collapsible and having sufficient resiliency to return to an uncollapsed state subsequent to forced collapsement, the accordian fold projections being internally hollow and open to the interior of the main body portions.

10. An assembly according to claim 7 including a pivotal closure member carried by the cap for closing the cap carried dispensing 11. The assembly of claim 10 wherein said cap portion is a snap on cap with means to snap affix the cap to the container.

12. The assembly according to claim 11 wherein said dispensing tube has a segment separated from the main body portion of the container by a space, the cap having means overlying the entirety of the dispensing tube and having snap-on means affixed thereto for grapsingly engaging the exterior of the tube to affix the cap to the container.

13. The assembly of claim 12 wherein the cap includes a recess therein, the pivotal closure member having a pivot intermediate the ends of the pivotal closure member, one end of the pivotal closure member overlying the recess whereby the one end of the pivotal closure member overlying the recess may be pivoted into the recess about the pivot to withdraw a plug member from the cap carried dispensing opening, the plug member being affixed adjacent to the other end of the pivotal closure member on a side of the pivot opposite the one end overlying the recess.

14. A dispensing container and container cap combination comprising: a blow molded plastics material container having an annular dispensing neck, and a main body portion, said neck having an open end closable by a closure cap, a dispensing tube formed as a portion of the main body portion having a first end open to an interior of the neck and spaced from the open end, and a second end open to an interior of the main body portion spaced from the neck, and the closure cap affixable to the neck having top means closing said open end and having means for dispensing and means formed integrally with the cap communicating said first end to said means for dispensing.

15. The combination of claim 14 including means for preventing contents flow communication between the main body portion and the dispensing means except through the tube.

16. The combination of claim 15 wherein the means for preventing is formed as a portion of said cap.

17. The combination of claim 16 wherein the neck has a throat area connection to the main body and the throat area includes openings from the main body and from the first end to the neck interior, the means for preventing including stopper means for closing the opening to the main body, while allowing the first end to communicate with the means for dispensing.

18. The combination of claim 17 wherein the opening to the main body is coaxial with the neck and the opening to the first end is offset from the axis of the neck.

19. The combination of claim 18 wherein the main body is a squeeze body.

20. The combination of claim 19 wherein the main body has at least one raised corrugated collapsible area for supplying squeeze pressure to the interior of the main body effective to increase interior pressure in the main body to force the contents thereof therefrom through the tube and means for dispensing.

* * * * *